US005588553A

United States Patent [19]

Farmont

[11] Patent Number: 5,588,553

[45] Date of Patent: Dec. 31, 1996

[54] ISSUING DEVICE FOR DISC-SHAPED PARKING TICKETS

[75] Inventor: Hans Farmont, Ratingen, Germany

[73] Assignee: Farmont Technik GmbH & Co. KG, Germany

[21] Appl. No.: 426,173

[22] Filed: Apr. 21, 1995

[30] Foreign Application Priority Data

Apr. 23, 1994 [DE] Germany ..... 44 14 303.6

[51] Int. Cl.[6] ..... G07F 11/00

[52] U.S. Cl. ..... 221/76; 221/256

[58] Field of Search ..... 332/69, 76, 266, 332/263, 277, 191, 255, 256

[56] References Cited

U.S. PATENT DOCUMENTS

| | | | |
|---|---|---|---|
| 2,063,356 | 12/1936 | Wiggins | 194/4 |
| 3,397,764 | 8/1968 | Simjian | 194/4 |
| 3,766,452 | 10/1973 | Burpee et al. | 317/262.8 |
| 4,101,701 | 7/1978 | Gordon | 428/189 |
| 4,257,436 | 3/1981 | Smith | 133/5 R |
| 4,319,674 | 3/1982 | Riggs et al. | 194/4 R |
| 4,380,699 | 4/1983 | Monnier et al. | 235/492 |
| 4,395,043 | 7/1983 | Gargione | 273/239 |
| 4,585,930 | 4/1986 | Casden | 235/449 |
| 4,674,618 | 6/1987 | Eglise et al. | 194/210 |
| 4,703,164 | 10/1987 | von Ballmoos | 235/384 |
| 4,717,815 | 1/1988 | Tomer | 235/378 |
| 4,788,102 | 11/1988 | Koning et al. | 428/40 |
| 4,865,222 | 9/1989 | Sullivan | 221/241 |
| 4,868,373 | 9/1989 | Opheij | 235/380 |
| 4,926,996 | 5/1990 | Eglise | 194/212 |
| 4,960,983 | 10/1990 | Inoue | 235/449 |
| 4,969,549 | 11/1990 | Eglise | 194/205 |
| 4,982,070 | 1/1991 | Bezin et al. | 235/378 |
| 4,990,759 | 2/1991 | Gloton et al. | 235/492 |
| 5,206,495 | 4/1993 | Kreft | 235/492 |
| 5,208,110 | 5/1993 | Smith et al. | 428/414 |

FOREIGN PATENT DOCUMENTS

| | | |
|---|---|---|
| 124 | of 1854 | European Pat. Off. . |
| 402821A | 3/1990 | European Pat. Off. . |
| 2625351 | 12/1987 | France . |
| 2231720 | 1/1973 | Germany . |
| 2557984 | 6/1977 | Germany . |
| 2628595 | 1/1978 | Germany . |
| 2926867 | 1/1981 | Germany . |
| 3307986 | 9/1983 | Germany . |
| 3339387 | 5/1984 | Germany . |
| 3608165 | 9/1986 | Germany . |
| 391375B | 3/1990 | Germany . |
| 4021770A | 1/1992 | Germany . |
| 4021770 | 1/1992 | Germany . |
| 60-215288 | 10/1985 | Japan . |
| 4004495 | 8/1992 | Japan . |
| 5-189626 | 7/1993 | Japan . |
| 654942 | 12/1978 | Switzerland . |
| 89/12286 | 12/1989 | WIPO . |
| 91/14237 | 9/1991 | WIPO . |

*Primary Examiner*—Kenneth Noland

*Attorney, Agent, or Firm*—Steven F. Caserza; Flehr, Hohbach, Test, Albritton & Herbert

[57] ABSTRACT

The invention relates to an issuing device for disc-shaped parking tickets, which device makes it possible for the parking tickets, provided for issuing, to be presented reliably, on a permanent and requirement-related basis, from a supply, and which is at the same time of a simple design. For this purpose, the issuing device for disc- shaped parking tickets, having a supply container for parking tickets comprises at least one target station for the removal of parking tickets, a transporter which runs between the supply container and the target station and is in the form of a drivable turntable which exhibits receptacles which are distributed over the circumference of the turntable and are intended for temporarily receiving in each case at least one parking ticket which is to be issued from the supply container and for guidance during the transporting movement of the turntable, and further comprises at least one measuring device for identification of the parking ticket which is to be issued in each case.

17 Claims, 3 Drawing Sheets

26
1
3
33
13
2
I
10
9
5
14
6
17
12
2
8
II
25
27
29
28
2
2
30
31
32

ISSUING DEVICE FOR DISC-SHAPED PARKING TICKETS

RELATED APPLICATIONS

This application is related to the following U.S. patent applications:

| Ser. No. | File Date |
|---|---|
| 08/357,546 | December 14, 1994 |
| 08/177,007 | January 3, 1994 |
| 08/176,956 | January 3, 1994 |
| 08/177,002 | January 3, 1994 |
| 08/177,006 | January 3, 1994 |
| 08/196,648 | February 15, 1994 |
| 08/309,093 | September 20, 1994 |

FIELD OF THE INVENTION

This invention relates to an issuing device for disc-shaped parking tickets.

BACKGROUND

Upon entry into charge-payable multi-story car parks or the like, disc-shaped parking tickets are issued to the user or customer, which parking tickets are used for billing parking and for actuating a departure parking barrier at the end of a parking period. The issuing of parking tickets, which is necessary for this purpose, in the entrance region requires an issuing device, which stores parking tickets and issues them to the user upon request, to be set up.

If the parking tickets are formed as parking tickets which can be issued a number of times and have an identification and/or communication element, then the parking tickets, in contrast to the hitherto customary parking tickets consisting of paper, are of a more compact design and generally consist of a rigid material, thus making it more difficult to issue the parking tickets separately, i.e. to issue one parking ticket upon request.

SUMMARY

The object of the present invention is to provide an issuing device for disc-shaped parking tickets, which device makes it possible for the parking tickets, provided for issuing, to be presented reliably, on a permanent and requirement-related basis, from a supply, and which is at the same time of a simple design.

This invention provides an issuing device for disc-shaped parking tickets which can receive a discrete number of parking tickets, from a supply of parking tickets, in the receptacles of the turntable and can feed them to a target station. In the case of an adequate and/or refillable supply of parking tickets, the issuing operation can consequently be carried out again and again, such that they can be issued upon request. In addition to covering a certain distance, the turntable permits alignment of the parking tickets, the guided movement of the parking tickets along a circular path facilitating lateral gripping upon delivery and discharge of the parking tickets. The same applies for the change between forwards operation and backwards operation of the turntable. In this arrangement, the turntable may also, in addition, be used as a separator for separating parking tickets from a supply stack. For this purpose, a horizontally running turntable preferably exhibits receptacles in the form of depressions which can be filled with individual parking tickets, in particular in each case one parking ticket. The depressions can be filled by utilizing the force of gravity acting on the parking-ticket stack, in that the supply container exhibits an outlet shaft which is intended for receiving a parking-ticket stack and, open on the base side, terminates above the turntable. The parking-ticket stack is then supported on the turntable via the lowermost parking ticket, the outlet shaft guiding the parking tickets of the stack laterally and thus retaining them in a stationary manner above the displaceable turntable.

If the depressions are arranged in the turntable such that, on their movement path with the turntable, they pass beneath the parking-ticket stack located in the outlet shaft, then, in dependence on the height of the depression, at least one parking ticket slips into the depression. Consequently, the at least one parking ticket passes out of the guide region of the outlet shaft and into a guide region which is defined by the depressions and is located in the turntable.

In order to make it possible for the at least one parking ticket introduced into a depression to be stripped off from the rest of the parking-ticket stack in a sliding manner, the height of the depression corresponds to the thickness of a parking ticket or is a whole multiple of the parking-ticket thickness. A particular advantage of such a stripper lies in the fact that, during its rotational movement, the turntable can carry out the separator function.

The number of circumferentially distributed receptacles or depressions in the turntable can be selected and is preferably four, it being possible for four successive stations along the circular path, in particular delivery station, measuring station, target station and retrieval station, to be assigned to said four receptacles or depressions. The time interval between the issuing of parking tickets is reduced with an increase in the number of receptacles since intermediate storage by the turntable increases, as a result of which the distance between the receptacles lying in each case one behind the other on the circumference is reduced. This also results in a reduction in the rotational movement which is necessary in order to move a receptacle with at least one parking ticket into the target station.

Furthermore, the turntable permits accommodation of the parking tickets with a gripping surface for removal by a car-park user at the target station. For this purpose, the depressions may be arranged on the border of the turntable such that the parking tickets project beyond the border of the turntable with a sub-portion. This sub-portion provides a gripping surface for the removal from the turntable.

If a removal slot of the issuing device is provided tangentially to the turntable, the projecting sub-portion of a parking ticket is pushed through the removal slot in the target station and can be seized there by a car-park user.

In order to read the identification of a parking ticket which is to be issued and/or to communicate therewith, provision is made for a measuring device which is provided along the path between supply container and target station. In order to permit contactless operation of the measuring device, the measuring device preferably comprises a transmitting and/or receiving aerial for electromagnetic radiation, which is tuned to a transmitting and/or receiving device integrated in the parking tickets.

Further configurations of the invention are given in the following description and the subclaims.

BRIEF DESCRIPTION OF THE DRAWINGS

The invention is explained in more detail herein-below with reference to the exemplary embodiments which are represented in the accompanying drawings, in which.

DETAILED DESCRIPTION

Figure 1:
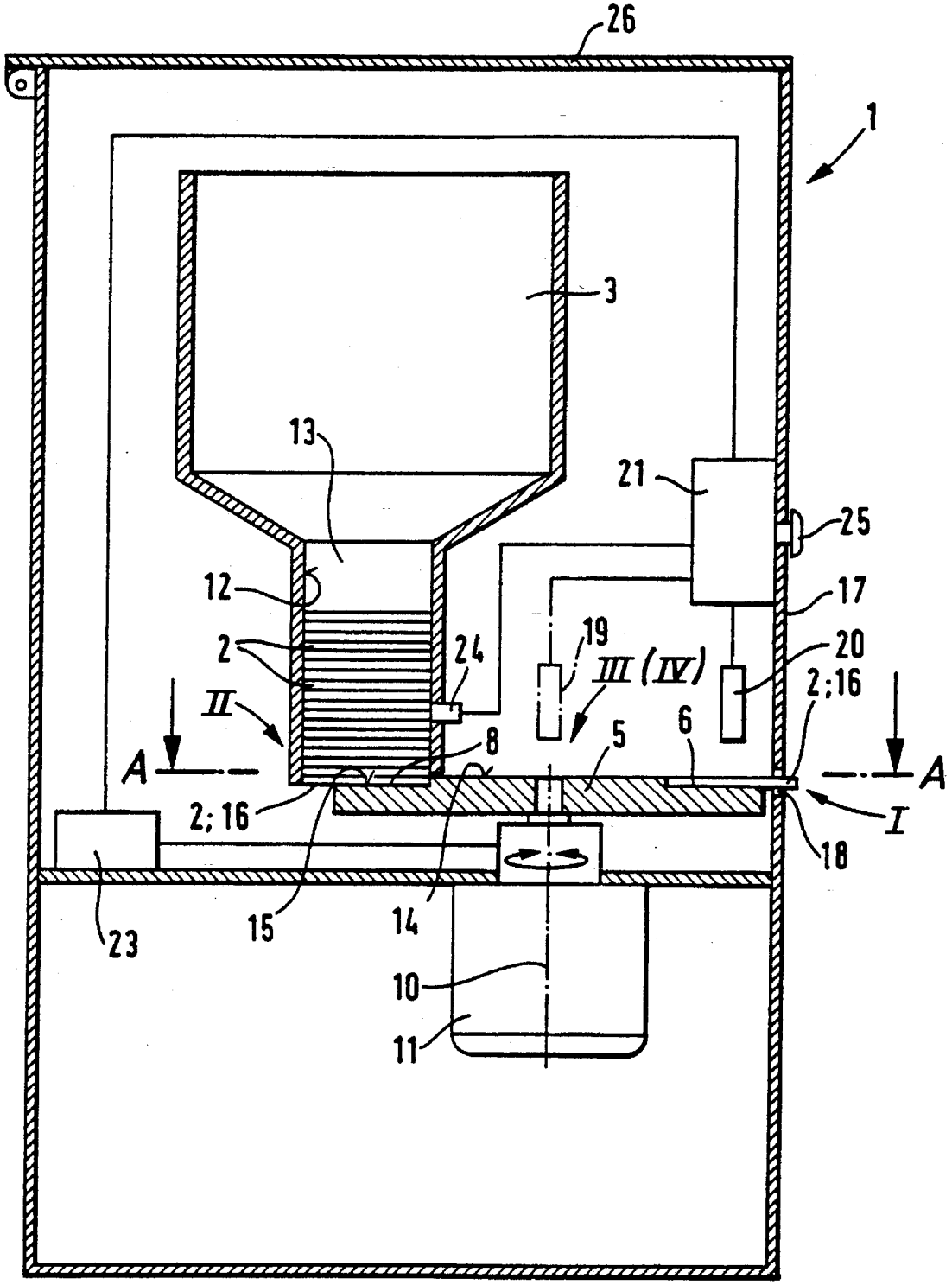
FIG. 1 shows, schematically, a longitudinal section of a first exemplary embodiment of an issuing device for disc-shaped parking tickets.

FIG. 1 shows a first exemplary embodiment of an issuing device 1 for disc-shaped parking tickets 2, which device can be set up at an entrance to a charge-payable multi-story car park or open-air car park. The opening of an entrance barrier (not shown) is linked with the issuing of a parking ticket 2, which serves for the individual calculation of the parking charges and as proof of authorization for departure.

The issuing device 1 includes a supply container 3 for a supply of parking tickets 2, said supply container 3 being arranged such that it is spaced apart from a target station 1. Displaceably arranged between the supply container 3 and the target station 1 is a turntable 5 which exhibits at least one receptacle 6, 7, 8 or 9 which is arranged on the border of said turntable and is intended for receiving at least one parking ticket 2. The parking tickets 2 provided for issuing are transported, by means of the turntable 5, from the supply container 3 to the target station 1, where removal of a parking ticket 2 by a user can take place in each case. Preferably, a plurality of, in particular, four, receptacles 6 to 9 are distributed over the circumference of the turntable and spaced apart from one another.

The turntable 5 is formed by a horizontally located planar disc which can be rotated about a vertical axis 10. A motor 11 is provided for the continuous or stepwise drive of the turntable 5 in the forward direction and/or the backward direction. The receptacles 6 to 9 are preferably formed by depressions in the turntable 5, said depressions being designed for receiving at least one flat parking ticket 2. In order that the turntable 5 can be used not only as a transporter, but also as a separator for filling the receptacle or receptacles 6 to 9 with parking tickets 2, the turntable 5 is arranged displaceably beneath an outlet shaft 12 which is provided at the outlet of the supply container 3.

The outlet shaft 12 terminates, with its base side open, above the turntable 5 and is designed for receiving a stack of parking tickets 2 located flat one upon the other, said stack being supported on the base of the turntable 5 by means of the respectively lowermost parking ticket 2. If the parking tickets are flat, round parking discs, then the outlet shaft 12 may be formed by a tube having a circular cross-section, the cross-section of an outlet duct 13 contained therein preferably only slightly exceeding the diameter of the disc-shaped parking tickets 2, in order to achieve good lateral guidance of the parking tickets 2 in the outlet shaft 12. The outlet shaft 12 terminates at a distance from the turntable 5 in such a manner that the lowermost parking ticket 2 is also subjected to lateral guidance by the outlet shaft 12 and thus, together with the rest of the stack of parking tickets 2, is retained in a stationary manner with respect to the rotating turntable 5 by means of said outlet shaft 12. In order to reduce the friction between the bearing side of the parking ticket 2 and the surface 14 of the turntable 5, the surface 14 may consist of a sliding material.

The turntable 5 is, furthermore, aligned with respect to the outlet shaft 12 such that, upon rotation of the turntable 5, the receptacle or receptacles 6 to 9 distributed over the circumference of the turntable assume, in a delivery station 11, a position, with respect to the outlet duct 13, in which the respective receptacle 6 to 9 can be displaced beneath the outlet duct 13 in order to receive at least one parking ticket 2. The supporting surface for the stack of parking tickets 2 in the outlet duct 13 is then a base 15 of the respective receptacle 6 to 9, designed as a depression. Said bases 15 are sunken with respect to the surface 14 of the turntable 5, with the result that the stack slips down deeper and at least the lowermost parking ticket 2 fills one of the receptacles 6 to 9. Upon rotation of the turntable 5 out of this delivery position, the inserted parking ticket or tickets 2 is or are retained by the receptacles 6 to 9 and thus stripped off from the stack, while the parking ticket located initially above the parking ticket or tickets 2 inserted into the turntable 5 comes to bear on the surface 14 of the turntable 5.

In order to be able to carry out this stripping operation in as uniform manner as possible, the sink-down level in the receptacles 6 to 9, i.e. the height of the depressions, is a whole-numbered multiple of the thickness of the parking tickets 2; a parking ticket 2 can preferably be inserted in the receptacles 6 to 9 in a manner flush with the surface 14 of the turntable 5. The turntable 5 then operates as a separator, i.e. it strips off a parking ticket 2 from a supply stack and transports it to the target station I, where removal by a user takes place. If a plurality of parking tickets 2 are inserted into a receptacle 6 to 9, further separation of the batch of parking tickets is necessary in the target station I or on the way there in order that the user can remove only one parking ticket 2.

The receptacles 6 to 9, designed as depressions, are preferably designed at the border such that the parking tickets 2 inserted into the receptacles 6 to 9 project beyond the turntable 5 with a sub-portion 16 or segment. This protruding sub-portion 16 does not bear on the base 15 and can thus be used as a gripping surface for removal from a receptacle 6 to 9 by the user.

For this purpose, in the target station I, a front wall 17 of the issuing device I is arranged with respect to the turntable 5 such that a parking ticket 2 transported into the target station I projects, with its protruding sub-portion 16, through a slot 18 provided in the front wall 17.

Figure 2:
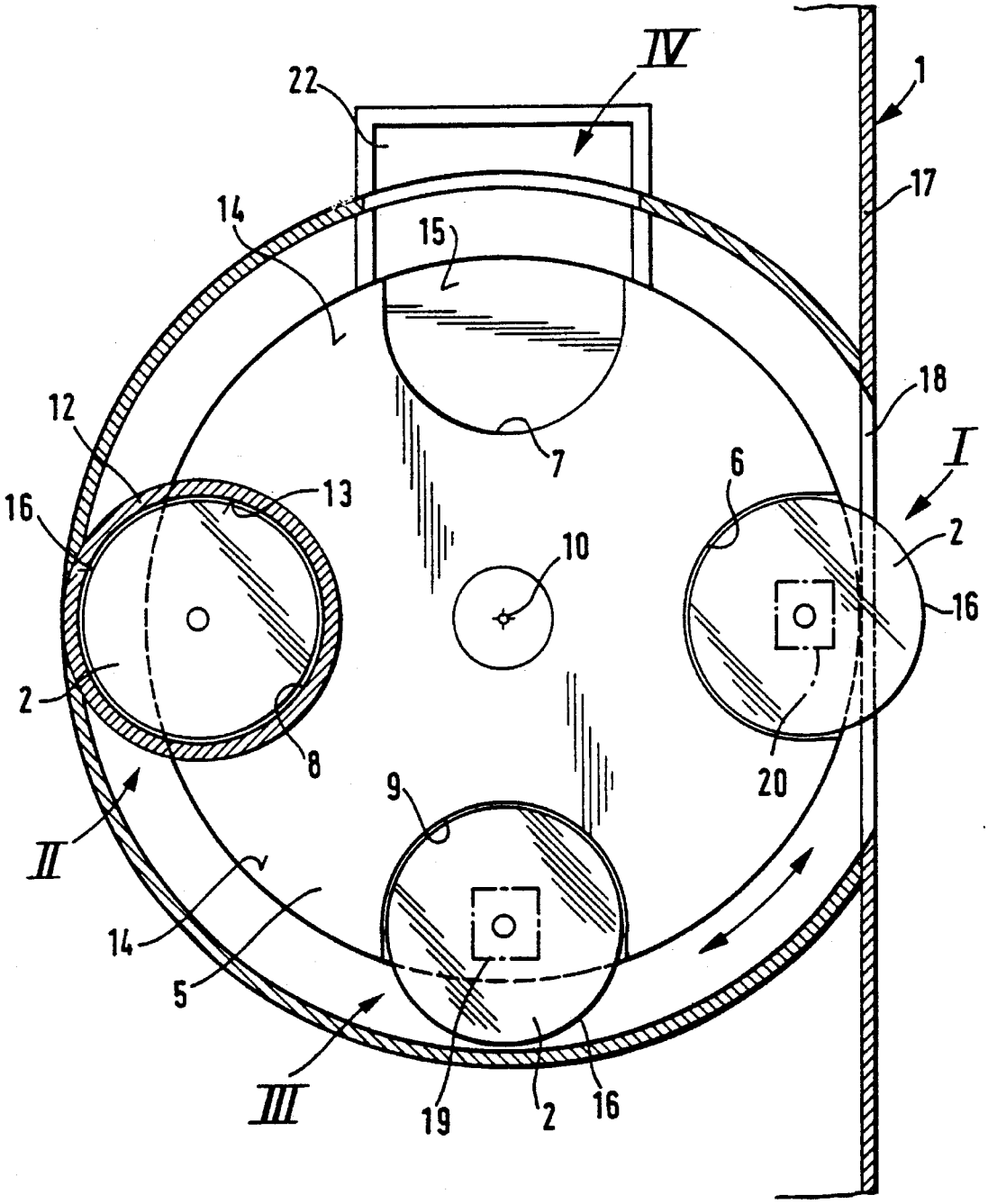
FIG. 2 shows, schematically, a cross-section along line A—A in FIG. 1.

As can be seen, in particular, in FIG. 2, the turntable 5, on the path between delivery station II and target station I, runs through a measuring station III with a measuring device 19, where the identification of a parking ticket 2 is read, said parking ticket having been inserted into the turntable 5 in the delivery station II and being provided for issuing in the target station I. The identification can be passed on to a computer which stores the identification along with parking data, such as entrance time, date, etc. In this arrangement, the measuring device 19 operates preferably in a contactless manner by means of data transmission by electromagnetic waves, and the parking tickets 2 preferably contain a transceiver.

The respective parking ticket 2 may, in addition, itself have parking information recorded on it, as long as it exhibits a communication element, in particular such as an electronic chip. For this purpose, the measuring station III includes a measuring device 19 which preferably exhibits an electronic reading and/or writing device.

In the target station I, there is preferably provided an electronic measuring element 20, which indicates the removal of a parking ticket 2 which is to be issued. Upon removal of the parking ticket 2, the measuring element 20 transmits a signal to a control device 21, which can then, inter alia, effect opening of an entrance parking barrier. The measuring element 20 may also be used to indicate the precise entrance time for a parking ticket 2 which has previously been identified in the measuring station, so that the electronic measuring device 19 is likewise connected to the control device 21. If appropriate, the measuring station III may be provided in the target station I, in which case in addition to the measuring element 20, the reading and/or writing device to be provided there as measuring device 19 or the measuring element 20 additionally to operate as such.

As can likewise be seen in FIG. 2, a retrieval station IV is provided, between target station I and delivery station II, along the circular path of the turntable 5. The retrieval station IV includes a collecting container 22 for parking tickets 2 which have not been issued or have not been removed and, upon passing the retrieval station IV, are transferred, via a suitable ejector device (not shown), from a receptacle 6 to 9 in the turntable 5 into the collecting container. The receptacle 6 to 9 filled by a parking ticket 2 which has not been removed or has not been issued is then free again to receive a parking ticket 2 in the delivery station II.

As has already been described, the turntable 5 can be moved around in a forward direction or backward direction, i.e. either to the right or left. According to FIG. 2, a left-hand rotation of the turntable 5 results in the receptacle 8, including the parking ticket 2, moving to the target station I via the measuring station III. If the parking ticket is removed there, the receptacle 8 is empty and, upon movement into and/or through the delivery station II, can be filled again with a parking ticket 2. If the parking ticket 2 is not removed in the target station I, then, upon further left-hand rotation of the turntable 5, the receptacle 8 can be moved into and/or through the retrieval station IV, where the parking ticket 2 which has not been removed can be ejected.

If the parking ticket 2 which has not been removed is to be issued once again, the receptacle 8 which is still occupied by the ticket can slide through the delivery station II by continuing the left-hand rotation, the parking ticket 2 which has not been removed forming, in the position beneath the outlet shaft 12, a supporting base, flush with the surface 14, for the stack of parking tickets 2 in the outlet duct 13. Thereafter, the receptacle 8 passes to the measuring station III again, etc.

Alternatively, the parking ticket 2 which has not been removed can be moved back out of the target station I to the measuring station III again by a backwards movement of the turntable 5 or by right-hand rotation, and can be prepared in said measuring station III for reissuing. The advancement to the various stations I to IV can thus be controlled individually and on a requirement-related basis, as is shown by the modes of operation described above by way of example.

The speed and/or standstill times of the turntable 5 can be regulated via a control unit 23 (FIG. 1) which is connected to the control device 21. The movement of the turntable 5 can thus be controlled in dependence on the signals of the measuring device 19 and/or of the measuring element 20. In this arrangement, the turntable 5 can be moved in a stepwise manner into the various stations I to IV or can run through said stations in a continuous movement.

The procedures described above for the receptacle 8 correspondingly apply to the other receptacles 7, 6 and 9, which, due to their fixed position with respect to one another on the turntable 5, advance up to the same stations I to IV one after the other. In order to accelerate the issuing operation, a plurality of receptacles are provided, with the result that, before an issuing operation is initiated by a user, a parking ticket 2 is already located in the turntable 5. This is the case according to FIG. 2 for the parking ticket 2 in the receptacle 9. The transportation of a parking ticket 2 into the target station I can be initiated via an actuating device 25 which is accessible to the user in the front wall 17. In the case of a plurality of receptacles 6 to 9, one request initiates operations at various receptacles simultaneously. For example, starting from the representation shown in FIG. 2, the movement of the turntable 5 for transporting the parking ticket 2 located in the receptacle 9 from the measuring station III to the target station I is utilized simultaneously for separating off a parking ticket 2, from the stack located at the outlet duct 13, by means of the receptacle 8 and for inserting said parking ticket into said receptacle 8 and transporting it into the measuring station III.

Instead of the actuating device 25, automatic automobile sensing devices, such as an induction loop, pressure plate, electric or optical beam may be utilized to sense the entry of the vehicle of the customer and thereafter, as described above, initiating the transportation of a parking ticket 2 into the target station I.

The supply of parking tickets 2 in the outlet shaft 12 can be monitored by means of a filling-level monitor 24, for example a light barrier, which preferably sends its indication to the control device 21. For refilling of the supply container 3, the issuing device I preferably exhibits a swing-up cover 26.

Figure 3:
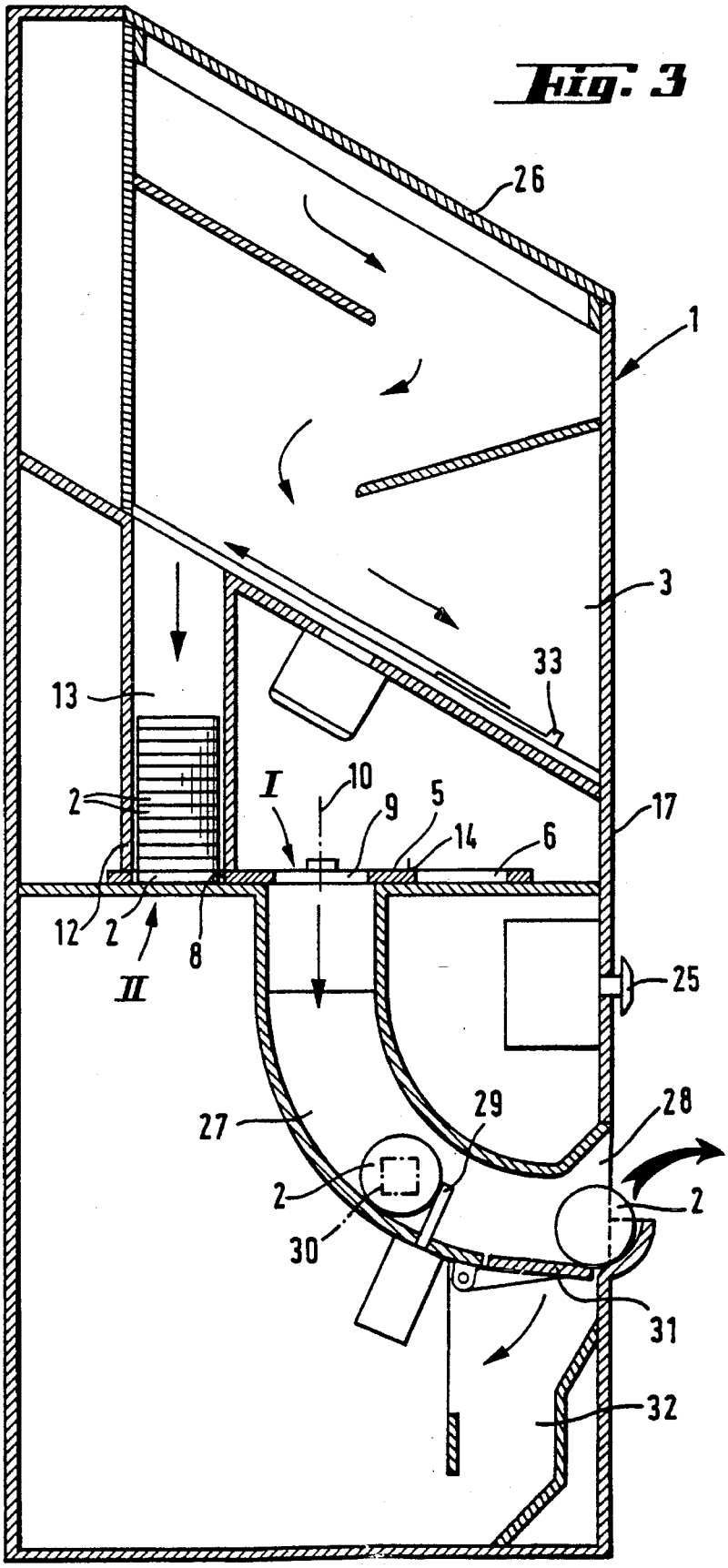
FIG. 3 shows, schematically, a longitudinal section of a second exemplary embodiment of an issuing device for disc-shaped parking tickets.

FIG. 3 shows a second exemplary embodiment of an issuing device I, which embodiment differs from the first exemplary embodiment essentially in that the target station I does not constitute a removal location which is accessible to the user. Rather, a falling shaft 27 is, here, arranged downstream of the target station I as an issuing duct which feeds the parking tickets 2 to a removal opening 28 located in the front wall 17 of the issuing device I. The turntable 5 here permits, in addition to intermediate storage of the parking tickets 2, in particular transfer of the parking tickets 2 from a space-saving, flat position in the outlet shaft 12 of the supply container 3 into a rollable, upright position in the falling shaft 27 beneath the turntable 5.

In order to transfer the parking ticket or tickets 2 deposited in a receptacle 6 to 9 into the falling shaft 27, for example the bases of the receptacles 6 to 9 may be designed such that they can be swung away, with the result that the at least one inserted parking ticket 2 can fall into the falling shaft 27 under the action of the force of gravity. Alternatively, the turntable 5 may be designed using a perforated disc which has perforations for receiving at least one parking ticket 2 and runs on an intermediate housing base, a through-passage opening for parking tickets 2 transported by the turntable 5 being provided in the target station I, i.e. at the point where the falling shaft 27 branches off.

In order that this initial falling movement results in an upright position of the parking ticket 2 which is received flat by the turntable 5, sliding surfaces (not shown) may be provided at the inlet of the falling shaft 27. The cross-section of the falling shaft 27 is selected such that the parking tickets 2 can slide or run downwards in a rolling, upright position.

At the outlet, the falling shaft 27 exhibits a barrier 29, blocking the through-passage of the falling shaft 27, in order that in each case only one parking ticket 2 passes into the issuing opening. One or more measuring stations 30 for reading the identification of the parking tickets 2 and/or for communicating therewith are preferably provided not, as is described in the case of the first exemplary embodiment, in the running region of the turntable 5, but in the region of the falling shaft 27.

Parking tickets 2 which have not been removed can be retrieved by the base surface being designed, in the region of the outlet opening 28, as a flap 31 which permits the parking ticket 2 located in the issuing opening to roll back and to be directed into a retrieval shaft 32.

In the same way as in the case of the first exemplary embodiment, the various functional and measuring elements 5, II, 29, 30, 31, etc. can be connected to a common control device for the individual control of the mode of operation of the issuing device, in particular as a result of an actuation of the actuation device 25 or a vehicle driving over an induction loop.

Provided as supply container 3 is a trough which has an ejector 33 which operates at the base and directs the parking tickets 2 into the outlet shaft 12. The type of usable supply container 3 can be selected. All that has to be ensured is that parking tickets 2 from a supply are located in a flat position at the outlet side, it being necessary for the outlet shaft 12 to be designed for receiving at least one flat parking ticket 2 in order to be able to utilize the turntable 5 as a separator.

The course of the parking tickets 2 through the issuing device 1 is indicated by arrows.

Although the invention has been described in connection with certain specific embodiments, it is to be understood that the invention is not limited to the disclosed embodiments, but rather, is intended to cower various modifications and equivalent arrangements included in the spirit and scope of the appended claims.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed:

1. An issuing device for disc-shaped parking tickets having a supply container for parking tickets having at least one target station for the removal of parking tickets, having a transporter which runs between the supply container and the target station and is in the form of a drivable turntable which exhibits receptacles which are distributed over the circumference of the turntable and are intended for temporarily receiving in each case at least one parking ticket which is to be issued from the supply container and for guidance during the transporting movement of the turntable, and having at least one measuring device for identification of the parking ticket which is to be issued in each case, wherein the turntable is arranged displaceably, as a stripper for parking tickets beneath an outlet duct which receives a parking ticket stack, is open on the base side and belongs to the supply container the parking-ticket stack, guided laterally by way of the outlet shaft being supported on the turntable by means of the respectively lowermost parking ticket, and the supporting level, in the region of the receptacles of the turntable, being sunken by the height of a parking ticket for the purpose of lateral release of at least the lowermost parking ticket.

2. An issuing device according to claim 1, wherein the vertical axis of the outlet shaft runs parallel to the axis of rotation of the turntable.

3. An issuing device for disc-shaped parking tickets having a supply container for parking tickets having at least one target station for the removal of parking tickets, having a transporter which runs between the supply container and the target station and is in the form of a drivable turntable which exhibits receptacles which are distributed over the circumference of the turntable and are intended for temporarily receiving in each case at least one parking ticket which is to be issued from the supply container and for guidance during the transporting movement of the turntable, and having at least one measuring device for identification of the parking ticket which is to be issued in each case, wherein the receptacles are formed by depressions in the turntable which are open at the border and are adapted to the contour of the parking tickets such that the parking tickets project freely beyond the turntable with a subportion in order to form a removal gripping surface on the parking tickets.

4. An issuing device for disc-shaped parking tickets having a supply container for parking tickets having at least one target station for the removal of parking tickets, having a transporter which runs between the supply container and the target station and is in the form of a drivable turntable which exhibits receptacles which are distributed over the circumference of the turntable and are intended for temporarily receiving in each case at least one parking ticket which is to be issued from the supply container and for guidance during the transporting movement of the turntable, and having at least one measuring device for identification of the parking ticket which is to be issued in each case, wherein a measuring station which exhibits the at least one measuring device is provided along the transporting path of the turntable between the supply container and target station.

5. An issuing device for disc-shaped parking tickets having a supply container for parking tickets having at least one target station for the removal of parking tickets, having a transporter which runs between the supply container and the target station and is in the form of a drivable turntable which exhibits receptacles which are distributed over the circumference of the turntable and are intended for temporarily receiving in each case at least one parking ticket which is to be issued from the supply container and for guidance during the transporting movement of the turntable, and having at least one measuring device for identification of the parking ticket which is to be issued in each case, wherein a retrieval station for parking tickets which are received by the turntable but not issued is provided along the transporting path of the turntable between target station and supply container.

6. An issuing device for disc-shaped parking tickets having a supply container for parking tickets having at least one target station for the removal of parking tickets, having a transporter which runs between the supply container and the target station and is in the form of a drivable turntable which exhibits receptacles which are distributed over the circumference of the turntable and are intended for temporarily receiving in each case at least one parking ticket which is to be issued from the supply container and for guidance during the transporting movement of the turntable, and having at least one measuring device for identification of the parking ticket which is to be issued in each case, wherein a measuring element is assigned to the target station in order to check the removal of a parking ticket.

7. An issuing device for disc-shaped parking tickets having a supply container for parking tickets having at least one target station for the removal of parking tickets, having a transporter which runs between the supply container and the target station and is in the form of a drivable turntable which exhibits receptacles which are distributed over the circumference of the turntable and are intended for temporarily receiving in each case at least one parking ticket which is to be issued from the supply container and for guidance during the transporting movement of the turntable, and having at least one measuring device for identification of the parking ticket which is to be issued in each case, wherein provision is made for a control and monitoring device which is intended for requirement-related actuation of the turntable and controls the removal of parking tickets while, if appropriate, simultaneously monitoring the extent to which the supply container is filled, by means of a filling-level monitor.

8. An issuing device for disc-shaped parking tickets having a supply container for parking tickets having at least one target station for the removal of parking tickets, having a transporter which runs between the supply container and the target station and is in the form of a drivable turntable which exhibits receptacles which are distributed over the circumference of the turntable and are intended for temporarily receiving in each case at least one parking ticket which is to be issued from the supply container and for guidance during the transporting movement of the turntable, and having at least one measuring device for identification of the parking ticket which is to be issued in each case, wherein the turntable can be activated, in order to transport a parking ticket to the target station by a vehicle driving over an induction loop.

9. An issuing device according to claims 1, 3, 4, 5, 6, 7, or 8, wherein the turntable is formed by a horizontally located planar disc which rotates about a vertical axis.

10. An issuing device according to claims 1, 3, 4, 5, 6, 7, or 8, wherein the receptacles are formed by depressions in the turntable, said depressions being adapted to the shape of the parking tickets and each receiving a flat parking ticket in a manner such that the respective parking-ticket upper side is flush with an upper side, which is planar in each case at least in the region between the depressions, of the turntable.

11. An issuing device according to claim 3, wherein on the target station, a removal slot extends tangentially with respect to the turntable in a wall of an enclosing housing, the respective parking ticket projecting through said removal slot with its protruding sub-portion.

12. An issuing device according to claims 1, 3, 4, 5, 6, 7, or 8, wherein the turntable comprises four receptacles which are spaced apart uniformly over the circumference.

13. An issuing device according to claims 1, 3, 4, 5, 6, 7, or 8, wherein the turntable can be displaced forwards and backwards.

14. An issuing device according to claims 1, 3, 4, 5, 6, 7, or 8, wherein the turntable can be driven in a stepwise manner.

15. An issuing device according to claims 1, 3, 4, 5, 6, 7, or 8, wherein the measuring device and/or the measuring element operate(s) in a contactless manner and is/are designed for receiving and/or transmitting electromagnetic signals.

16. An issuing device according to claims 1, 3, 4, 5, 6, 7, or 8, wherein a falling shaft for the further transportation, under the action of the force of gravity, of parking tickets to be issued is arranged downstream of the target station.

17. An issuing device according to claim 16, wherein the control and monitoring device can be activated by an actuating knob.

* * * * *